US009074857B2

(12) United States Patent
Cranor

(10) Patent No.: US 9,074,857 B2
(45) Date of Patent: Jul. 7, 2015

(54) MULTI-MARKER MARKING SYSTEM

(75) Inventor: Earl Cranor, Longmeadow, MA (US)

(73) Assignee: Cyalume Technologies, Inc., W. Springfield, MA (US)

( * ) Notice: Subject to any disclaimer, the term of this patent is extended or adjusted under 35 U.S.C. 154(b) by 876 days.

(21) Appl. No.: 13/279,969

(22) Filed: Oct. 24, 2011

(65) Prior Publication Data

US 2012/0097091 A1 Apr. 26, 2012

Related U.S. Application Data

(60) Provisional application No. 61/406,152, filed on Oct. 24, 2010.

(51) Int. Cl.
*F21S 10/00* (2006.01)
*F42B 12/40* (2006.01)

(52) U.S. Cl.
CPC ..... *F42B 12/40* (2013.01)

(58) Field of Classification Search
CPC ..... F21S 10/00; F42B 12/40; F21K 2/06; C09K 11/07; F41J 2/02
USPC ..... 116/200–203, 209, 211–212, 67 R, 116/DIG. 14; 102/513; 362/34, 84
See application file for complete search history.

(56) References Cited

U.S. PATENT DOCUMENTS 3,496,906 A * 2/1970 Gerke ..... 116/211
3,515,070 A * 6/1970 Cutler et al. ..... 102/513
3,736,874 A * 6/1973 Gerber ..... 102/382
3,940,605 A * 2/1976 Gerber ..... 362/34
4,640,193 A * 2/1987 Koroscil ..... 102/336
5,018,450 A * 5/1991 Smith ..... 102/513
5,508,893 A * 4/1996 Nowak et al. ..... 362/34
5,661,257 A * 8/1997 Nielson et al. ..... 102/334
6,298,841 B1 * 10/2001 Cheng et al. ..... 124/56
6,931,993 B1 * 8/2005 Manole et al. ..... 102/458
6,990,905 B1 1/2006 Manole et al.
7,055,438 B1 * 6/2006 Manole et al. ..... 102/513
7,475,638 B2 1/2009 Haeselich
7,487,728 B2 * 2/2009 Cranor ..... 102/513
8,376,561 B2 * 2/2013 Longo ..... 362/34

(Continued)

FOREIGN PATENT DOCUMENTS

DE 10 2005 053491 A1 5/2007

OTHER PUBLICATIONS

International Search Report and Written Opinion in PCT/US2011/057485 dated Jan. 30, 2012, 14 pages.

*Primary Examiner* — R. A. Smith
*Assistant Examiner* — Tania Courson
(74) *Attorney, Agent, or Firm* — McHale & Slavin, P.A.

(57) ABSTRACT

The disclosure relates to a marking system comprising at least one module, which comprises at least two sections, wherein the at least one module fails upon an expulsion charge initiation or a delayed expulsion charge initiation, and wherein the at least two sections each independently comprise at least one system chosen from a fluorescent system, a thermal-generating system, and a chemical light system. In some embodiments, a section of a module as disclosed herein comprises a heat/light system that generates both heat and light signals. The heat/light system comprises at least one first part comprising at least one oxalate ester, at least one fluorescer, and at least one inorganic salt, and at least one second part comprising at least one peroxide and at least one catalyst.

20 Claims, 3 Drawing Sheets

(56) References Cited

U.S. PATENT DOCUMENTS

| | | | | |
|---|---|---|---|---|
| 8,438,978 | B2 * | 5/2013 | Sullivan et al. | 102/513 |
| 8,584,590 | B2 * | 11/2013 | Cranor et al. | 102/513 |
| 8,584,591 | B2 * | 11/2013 | Cranor et al. | 102/513 |
| 2002/0134274 | A1 * | 9/2002 | Martinez et al. | 102/513 |
| 2007/0079722 | A1 * | 4/2007 | Parish | 102/513 |
| 2008/0229964 | A1 * | 9/2008 | Cranor | 102/513 |
| 2010/0282117 | A1 * | 11/2010 | Cranor et al. | 102/513 |
| 2010/0282118 | A1 * | 11/2010 | Ladyjensky et al. | 102/513 |
| 2011/0084243 | A1 | 4/2011 | Cranor et al. | |
| 2012/0097062 | A1 * | 4/2012 | Scanlon et al. | 102/513 |
| 2012/0227614 | A1 * | 9/2012 | Sullivan | 102/513 |
| 2012/0255458 | A1 * | 10/2012 | Sullivan et al. | 102/513 |
| 2014/0041545 | A1 * | 2/2014 | Aw et al. | 102/513 |

* cited by examiner

MULTI-MARKER MARKING SYSTEM

This application claims the benefit of priority under 35 U.S.C. §119 to U.S. Provisional Application No. 61/406,152 filed on Oct. 24, 2010, which is incorporated herein by reference.

The present disclosure relates to a multi-marker marking system that is suitable for propelling and/or that has time delay activation. The marking system can be used in military and non-military training, and in tactical operations.

Markers are used by both military and non-military organizations in training, tactical operations, and on the battlefield. The markers act to visually identify targets such as the ground location of enemy equipment and vehicles. Additionally, tracers are employed that allow an observer to visually trace a projectile's trajectory, such as after the firing of munitions.

Military forces participating in night operations are normally equipped with various different types of vision devices, including night vision goggles, thermal goggles, and thermal cameras. Frequently, personnel within one unit will be equipped with different types of vision devices. For example, a troop carrier may have a gunner using thermal goggles and troops using night vision goggles. A marker that emits a chemiluminescent signal will be visible to the troops with night vision goggles, but not to the gunner with the thermal goggles. Similarly, the gunner with thermal goggles will be able to see a heat marker, but the troops with the night vision goggles will not.

Additionally, there may be variations within the night vision goggles with regard to what micron wavelength the goggles operate in, leading to a variation in the wavelengths of light that are visible to a certain night vision goggles. Currently, there is not one marker that would be visible with all of the different types of vision devices that military personnel may be equipped with. Moreover, it is also desirable to have a marking system that generates signals visible in daylight and darkness. There is therefore a need for such a marking system that may be visible in daylight and with thermal and/or night vision devices in darkness.

DESCRIPTION OF THE EMBODIMENTS

Figure 1:
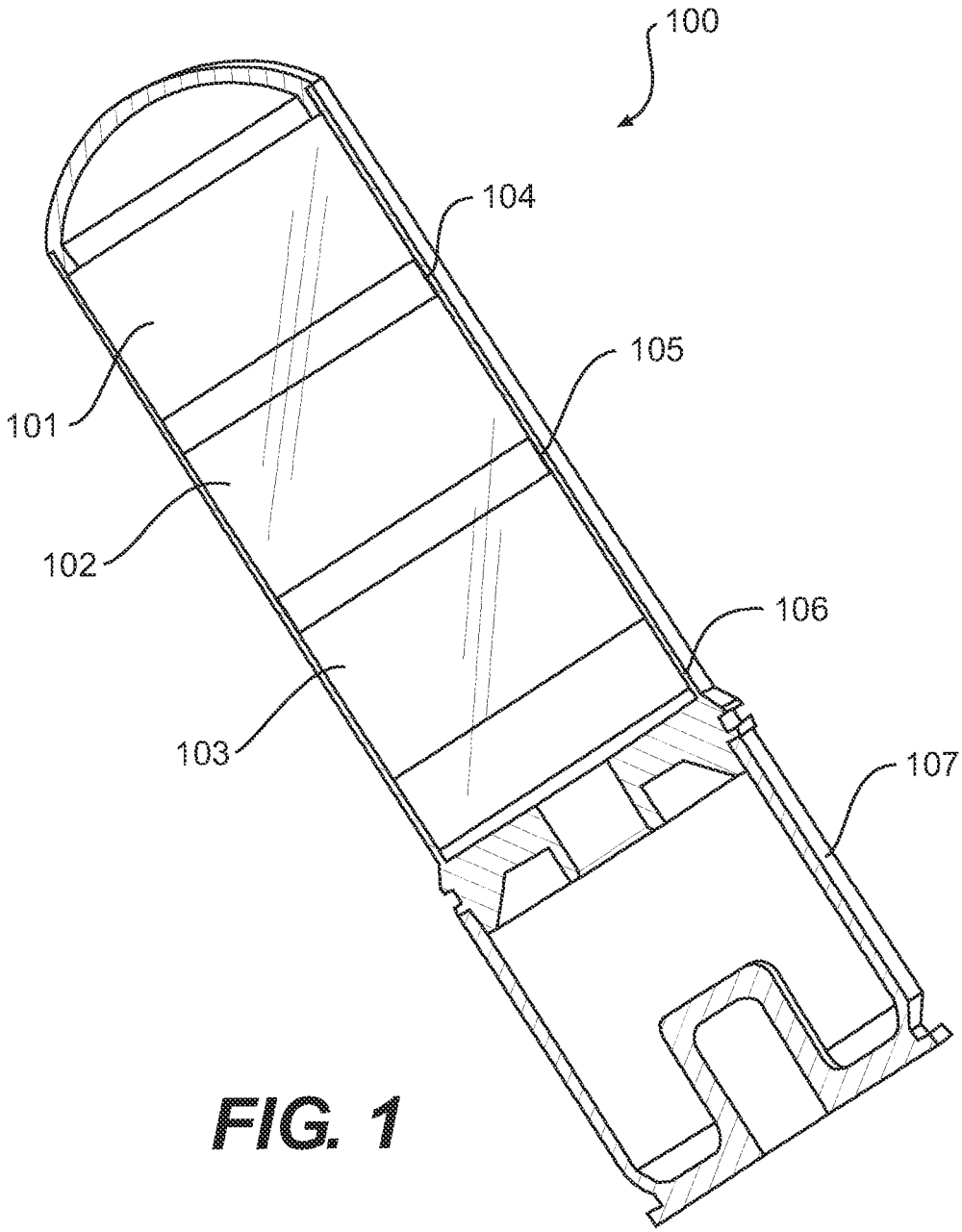
FIG. 1 illustrates a 40 mm grenade having a module with three sections separated by three separate expulsion charges.

The present disclosure generally relates to a multiple-marker marking system. "Multiple-marker" means that the marking system can generate multiple signals, such as heat and/or light (e.g., in different colors), which can be detected by naked eye and/or by certain visual equipments, such as night visions goggles, thermal goggles, and/or thermal cameras. The multiple-marker marking system can be included within a projectile such that the marking system can be launched into a distance.

Thus, the present disclosure relates to a marking system comprising at least one module, which comprises at least two sections, wherein the at least one module fails upon an expulsion charge initiation, and wherein the at least two sections each independently comprise at least one system chosen from a fluorescent system, a thermal-generating system, and a chemical light system. In some embodiments, the marking system may comprise at least two, e.g., three, four, or five modules. In some embodiments, the module comprises at least two, e.g., three, four, or five sections. For example, a marking system may comprise one module, which comprises three sections, e.g., a first section, a second section, and a third section. The first section may comprise a fluorescent system, the second section may comprise a thermal-generating system, and the third section may comprise a chemical light system. In another example, the first section may comprise a fluorescent system and a chemical light system, the second section may comprise a chemical light system and a thermal-generating system, and the third section may comprise a chemical light system. In a further example, the first section may comprise a fluorescent system, a chemical light system, and thermal-generating system, the second section may comprise another fluorescent system, another chemical light system, and another thermal-generating system, and the third section may comprise yet another fluorescent system, yet another chemical light system, and yet another thermal-generating system.

The present disclosure also relates to a marking system comprising at least one module, which comprises at least two sections, wherein the at least one module fails upon a delayed expulsion charge initiation, and wherein the at least two sections each independently comprise at least one system chosen from a fluorescent system, a thermal-generating system, and a chemical light system. For example, in certain embodiments, if a marking system comprises two modules, one module can fail upon an expulsion charge initiation and the other can fail upon a delayed expulsion charge initiation.

The present disclosure also relates to a marking system comprising at least three modules, for example, four, five, or six modules. In some embodiments, a marking system comprises at least three modules, wherein at least one of the at least three modules fail upon an expulsion charge initiation, wherein each of the at least three modules comprises a first section, a second section, and a third section, and wherein the first, second, and third sections independently comprise at least one system chosen from a fluorescent system, a thermal-generating system, and a chemical light system. In some embodiments, a marking system comprises at least three modules, wherein at least one of the at least three modules fail upon a delayed expulsion charge initiation, wherein each of the at least three modules comprises a first section, a second section, and a third section, and wherein the first, second, and third sections independently comprise at least one system chosen from a fluorescent system, a thermal-generating system, and a chemical light system.

In some embodiments, a marking system may comprise three modules, and each module may comprise three sections, each of which may independently comprise at least one system chosen from a fluorescent system, a thermal-generating system, and a chemical light system. The modules may be the same or different in terms of the content of the sections, i.e., a fluorescent system, a thermal-generating system, a chemical light system, or any combination thereof. Accordingly, different modules may generate different signals, whether it is light, e.g., in different color, and/or heat.

The present disclosure also relates to a marking system comprising at least one first part comprising a first module, at least one second part comprising a second module, and at least one third part comprising a third module, wherein at least one of the modules fails upon expulsion charge initiation, and wherein at least one of the modules comprises a fluorescent system and a chemical light system that generates substantially the same color.

The present disclosure also relates to a marking system comprising at least one first part comprising a first module, at least one second part comprising a second module, and at least one third part comprising a third module, wherein at least one of the modules fails upon a delayed expulsion charge initiation, and wherein at least one of the modules comprises a fluorescent system and a chemical light system that generates substantially the same color.

The term "fail" as used herein means that a certain section or module is activated such that a signal, e.g., light or heat, is generated. "Light" as disclosed herein may be, but not limited to, visible, ultra-violet, and infrared light.

In some embodiments, a module as disclosed herein comprises at least two sections, for example, two, three, four, or five sections. In some embodiments, a module comprises three sections, e.g., a first section, a second section, and a third section. The first, second, and third sections may each independently comprise at least one system chosen from a fluorescent system, a thermal-generating system, and a chemical light system. In certain embodiments, the first section comprises a fluorescent system, a thermal-generating system, and a chemical light system, wherein the fluorescent system and the chemical light system generate substantially the same first color. The second section comprises a fluorescent system, a thermal-generating system, and a chemical light system, wherein the fluorescent system and the chemical light system generate substantially the same second color. The third section comprises a fluorescent system, a thermal-generating system, and a chemical light system, wherein the fluorescent system and the chemical light system generate substantially the same third color. At least two of the first, second, and third colors may be different. All three of the first, second, and third colors may be the same or different.

In certain embodiments, for example, a module comprises three sections, i.e., a first section, a second section, and a third section. The first section may generate a blue color, the second section may generate a yellow color, and the third section may generate a red color. The colors may be generated by chemiluminescence, fluorescence, or both. If a certain section contains both a fluorescent system and a chemical light system, the two systems may generate the same or substantially the same color. Of course, if a module contains more than three sections, any section of the module may generate a signal that is different from any other section of the same or different module.

In certain embodiments, the marking system generates a signal that is visible in the daylight and/or a signal that is visible in darkness. For example, the signal that is visible in the daylight may be generated by a fluorescent system. The signal that is visible in darkness may be generated by a chemical light system and/or a thermal-generating system.

In certain embodiments, the marking system as disclosed herein is included within a projectile chosen from 18 mm rocket propelled grade munitions, howitzer shells, gravity bombs, small caliber munitions used in pistols, small caliber munitions use in handguns, medium caliber munitions ranging from 20 mm to 83 mm, and larger caliber munitions ranging from 83 mm to 155 mm. For example, the marking system can be included within 40 mm projectile.

FIG. 1 illustrates a 40 mm grenade having one module (100), which includes three sections, i.e., section 1 (101), section 2 (102), and section 3, separated by three separate expulsion charges (104-106). The body of the propellant base is referenced as 107 in FIG. 1.

Section 1, section 2, and section 3 can each contain any of the systems disclosed herein, such as a chemical light system, e.g., a heat/light system, and fluorescent powder, wherein the chemical light system and the fluorescent powder in the same section generate substantially the same color. The chemical light system and the fluorescent powder in one section, e.g., section 1, however, are different from the chemical light system and the fluorescent powder in another section, e.g., section 2, such that each of three sections give out different colored signals, whether it is in daylight or in darkness. For example, the chemical light system can include two parts (a first part and a second part), each of which is enclosed in a separate ampoule (not shown in the figure). The first part comprises at least one fluorescer, at least one oxalate ester, and at least one inorganic salt. The second part comprises at least one peroxide and at least one catalyst. A time delay fuse initiated with the firing of the grenade ignites the expulsion charges while the round is in flight, blowing the three different sections out of the grenade and away from each other. Upon impact, the ampoules containing the first part and the second part in a certain section, e.g., section 1, are broken such that the two parts in that section mix and react with each other, generating a heat and color signal in the air. Since the three sections contain different chemical light systems and fluorescent powders, upon impact, section 1, section 2, and section 3 generate three distinct colors in the air. It is intended that the individual sections in FIG. 1 can contain any of the systems disclosed herein.

Figure 2:
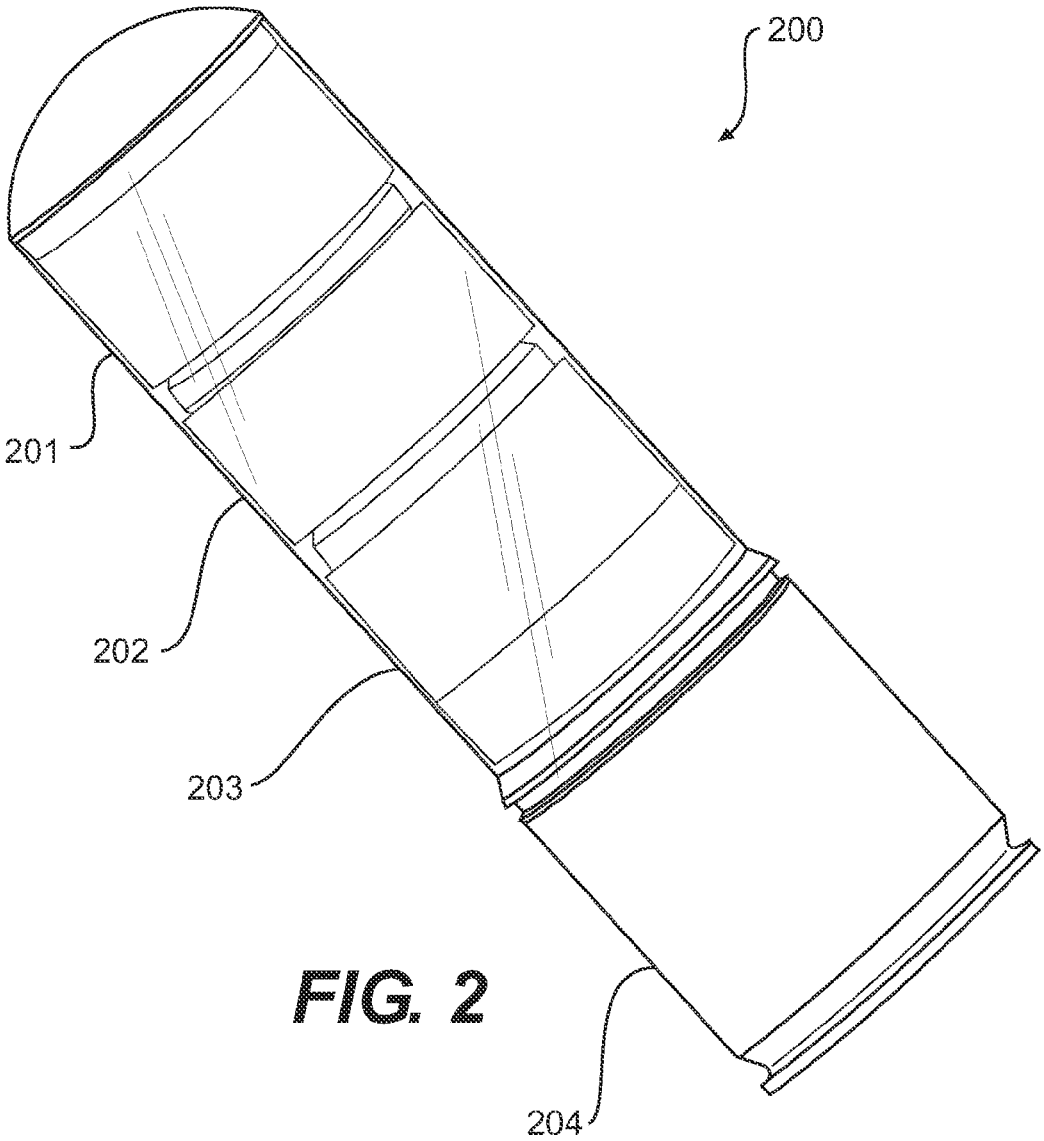
FIG. 2 illustrates a 40 mm grenade having three modules with a time delayed expulsion charge at the bottom of the stack of modules.

FIG. 2 illustrates a 40 mm grenade (200) having three separate modules, i.e., module 1 (201), module 2 (202), and module 3 (203). Each module can be a module as illustrated in FIG. 1 and described herein. A time delayed expulsion charge (204) at the bottom of the stack of the three modules blows the modules out of the grenade body in flight, dropping three separate and distinct glowing modules through the air and to the ground. It is intended that the individual modules in FIG. 2 can contain any of the systems disclosed herein.

Figure 4:
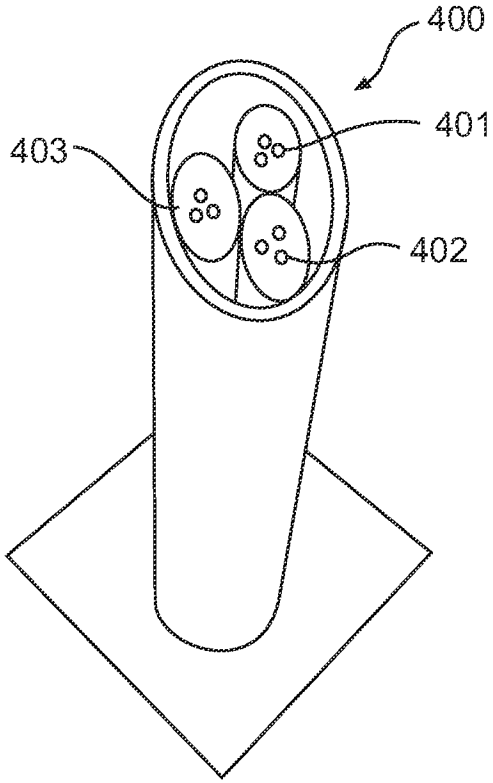
FIG. 4 illustrates an air cannon having three longitudinal modules.

FIG. 4 illustrates an air cannon (400) having three longitudinal modules, i.e., longitudinal module 1, longitudinal module 2, and longitudinal module 3. Each module can be a module as illustrated in FIG. 1 and described herein. The air cannon simulates the effect of an expulsion charge in a conventional munition. When the air cannon is fired, the three longitudinal modules are blown into the sky, simulating the effect that would be created by a munition loaded with the modules.

Figure 3:
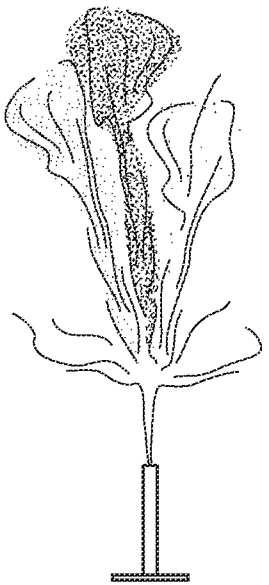
FIG. 3 illustrates a daytime simulation fired from air cannon.
Figure 5:
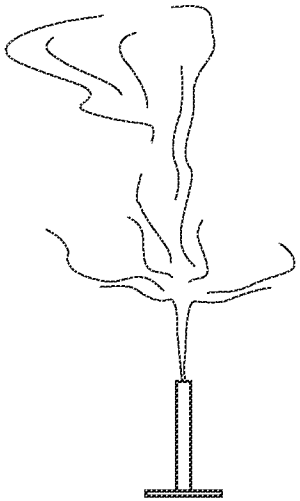
FIG. 5 shows another daytime simulation fired from air cannon.

FIG. 3 shows a daytime simulation fired from air cannon. FIG. 5 shows another daytime simulation fired from air cannon. Since the simulation marking systems as illustrated in FIGS. 3 and 5 comprise at least one appropriate fluorescer, e.g., fluorescent powders, the fluorescent signals can be visible in daylight As disclosed herein, a chemical light system includes any system that generates a signal via, but not limited to, chemiluminescence. Chemiluminescence relates to the production of light attributable to a chemical reaction.

In certain embodiments, the chemical light system may act as a thermal-generating system. For example, a chemical light system may generate light, and at or around the same time, generate heat.

In certain embodiments, the disclosure provides a chemical light and thermal system that is visible to personnel employing both thermal goggles and night vision goggles. This can be achieved by employing a heat/light system, which can emit both light and heat signals upon activation. The heat/light system comprises at least a first part comprising at least one oxalate ester, and at least one inorganic salt, and at least a second part comprising at least one peroxide and at least one catalyst. The at least first part may further comprise at least one fluorescer. Light and heat signals can be emitted when the first and second parts interact.

The intensity of the light and heat emitted increases as the parts of the heat/light system mix, and can reach a peak emission upon complete mixing and reaction of the at least two components together. The speed of mixing of the parts is dependent upon the practical application of the marking system. At labscale, the speed of mixing is typically dependent upon how fast one part of the marking system is injected into the second part of the solution. However, when the marking system is employed within munitions or projectiles, the intense speed and rotation of the munitions or projectiles can act to completely mix the multiple-parts together almost instantaneously upon firing, and as such can allow for the peak light and heat emission to be reached almost instantaneously.

The wavelength of light emitted is dependent upon the desired application of the marker and the fluorescer chosen, and can include wavelengths in the visual, ultra-violet, and infrared spectrum. It may be preferable to combine multiple fluorescers within one marking system to allow for the emission of light at multiple wavelengths.

The reaction rate of the marking system can be dependent upon the amount of catalyst employed and proceeds according to first order kinetics dependent upon the temperature at which the reaction is conducted. The intensity of the light emission can also be dependent upon the amount of catalyst, the completeness of mixing, and the amount of fluorescer employed.

As disclosed herein, the certain systems of the present disclosure have the ability to emit both light and heat. The heat may be, for example, a product of the catalytic breakdown of the hydrogen peroxide by the inorganic salt. However, not all inorganic salts will act to allow the marking system to emit both light and heat. Inorganic salts such as calcium chloride or sodium acetate may act to kill the light reaction and do not provide adequate light emission. The at least one inorganic salt useful in the present disclosure are chosen from sodium thiosulphate, potassium thiosulphate, cobalt acetate, copper acetate, lead acetate, cupric chloride, ferric chloride, calcium iodide, potassium iodide, and silver nitrate. In certain embodiments, the at least one inorganic salt is present in an amount ranging from 0.1 percent to 30 percent by weight, based on the total weight of the two-part composition. For example, the at least one inorganic salt can be present in an amount ranging from 1 percent to 30 percent by weight, based on the total weight of the two-part composition, such as from 5 percent to 30 percent by weight, from 5 percent to 25 percent by weight, from 10 percent to 25 percent by weight, and from 10 percent to 20 percent by weight.

Examples of the at least one oxalate useful in the systems of the present disclosure include bis(2,4,5-trichloro-6-carbopentoxyphenyl)oxalate; bis(2,4,5-trichlorophenyl)oxalate; bis(2,4,5-tribromo-6-carbohexoxyphenyl)oxalate; bis(2,4,5-trichloro-6-carboisopentoxyphenyl)oxalate; bis(2,4,5-trichloro-6-carbobenzoxyphenyl) oxalate; bis(2-nitrophenyl) oxalate; bis(2,4-dinitrophenyl)oxalate; bis(2,6-dichloro-4-nitrophenyl)oxalate; bis(2,4,6-trichlorophenyl)oxalate; bis (3-trifluoromethyl-4-nitrophenyl)oxalate; bis(2-methyl-4,6-dinitrophenyl)oxalate; bis(1,2-dimethyl-4,6-dinitrophenyl) oxalate; bis(2,4-dichlorophenyl)oxalate; bis(2,4-dinitrophenyl)oxalate; bis(2,5-dinitrophenyl)oxalate; bis(2-formyl-4-nitrophenyl)oxalate; bis(pentachlorophenyl)oxalate; bis(1,2-dihydro-2-oxo-1-pyridyl)glyoxal; bis(2,4-dinitro-6-methylphenyl)oxalate; bis-N-phthalimidyl oxalate, oxalates represented by the general formula (I)

(I)

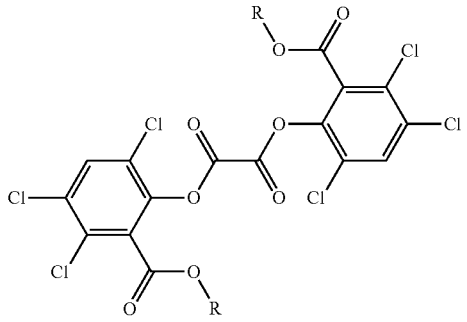

wherein R═$CH_2A$ and A is chosen from alkyl chains, alkyl rings, and aromatic rings or combinations thereof, such that R is linear or nonlinear, and such that R comprises from 4-15 carbons, and mixtures of any of the foregoing oxalates.

Examples of oxalates represented by formula (I) include:

bis{3,4,6-trichloro-2-[(2-methylpropoxy)carbonyl] phenyl}oxalate;
bis{3,4,6-trichloro-2-[(cyclopropylmethoxy)carbonyl] phenyl}oxalate;
bis{3,4,6-trichloro-2-[(2-methylbutoxy)carbonyl] phenyl}oxalate;
bis{3,4,6-trichloro-2-[(3-methylbutoxy)carbonyl] phenyl}oxalate;
bis{3,4,6-trichloro-2-[(2,2-dimethylpropoxy)carbonyl] phenyl}oxalate;
bis{3,4,6-trichloro-2-[(2-methylpentyloxy)carbonyl] phenyl}oxalate;
bis{3,4,6-trichloro-2-[(3-methylpentyloxy)carbonyl] phenyl}oxalate;
bis{3,4,6-tri chloro-2-[(4-methylpentyloxy)carbonyl] phenyl}oxalate;
bis{3,4,6-trichloro-2-[(3,3-dimethylbutoxy)carbonyl] phenyl}oxalate;
bis{3,4,6-trichloro-2-[(2-ethylbutoxy)carbonyl] phenyl}oxalate;
bis{3,4,6-trichloro-2-[(cyclopentylmethoxy)carbonyl] phenyl}oxalate;
bis{3,4,6-trichloro-2-[(2-methylhexyloxy)carbonyl] phenyl}oxalate;
bis{3,4,6-trichloro-2-[(3-methylhexyloxy)carbonyl] phenyl}oxalate;
bis{3,4,6-trichloro-2-[(4-methylhexyloxy)carbonyl] phenyl}oxalate;
bis{3,4,6-trichloro-2-[(5-methylhexyloxy)carbonyl] phenyl}oxalate;
bis{3,4,6-trichloro-2-[(cyclohexylmethoxy)carbonyl] phenyl}oxalate;
bis{3,4,6-trichloro-2-[(phenylmethoxy)carbonyl] phenyl}oxalate;
bis{3,4,6-trichloro-2-[(2-phenylethoxy)carbonyl] phenyl}oxalate;
bis(3,4,6-trichloro-2-{[(2-methylphenyl)methoxy] carbonyl}phenyl)oxalate;
bis(3,4,6-trichloro-2-{[(3-methylphenyl)methoxy] carbonyl}phenyl)oxalate;

bis(3,4,6-trichloro-2-{[(4-methylphenyl)methoxy] carbonyl}phenyl)oxalate;
bis(3,4,6-trichloro-2-{[(2,3-dimethylphenyl)methoxy] carbonyl}phenyl)oxalate;
bis(3,4,6-trichloro-2-{[(2,4-dimethylphenyl)methoxy] carbonyl}phenyl)oxalate;
bis(3,4,6-trichloro-2-{[3,4-dimethylphenyl)methoxy] carbonyl}phenyl)oxalate;
bis(3,4,6-trichloro-2-{[(3,5-dimethylphenyl)methoxy] carbonyl}phenyl)oxalate;
bis(3,4,6-trichloro-2-{[(2,6-dimethylphenyl)methoxy] carbonyl}phenyl)oxalate;
bis(3,4,6-trichloro-2-{[(2-ethylphenyl)methoxy] carbonyl}phenyl)oxalate;
bis(3,4,6-trichloro-2-{[(3-ethylphenyl)methoxy] carbonyl}phenyl)oxalate;
bis(3,4,6-trichloro-2-{[(4-ethylphenyl)methoxy] carbonyl}phenyl)oxalate;
bis(3,4,6-trichloro-2-{[2-(2-methylphenyl)ethoxy] carbonyl}phenyl)oxalate;
bis(3,4,6-trichloro-2-{[2-(3-methylphenyl)ethoxy] carbonyl}phenyl)oxalate;
bis(3,4,6-trichloro-2-{[2-(4-methylphenyl)ethoxy] carbonyl}phenyl)oxalate;
bis{3,4,6-trichloro-2-[(2-phenylpropoxy)carbonyl] phenyl}oxalate;
bis{3,4,6-trichloro-2-[(3-phenylpropoxy)carbonyl] phenyl}oxalate;
bis{3,4,6-trichloro-2-[1-naphthalenylmethoxy)carbonyl] phenyl}oxalate;
bis{3,4,6-trichloro-2-[2-naphthalenylmethoxy)carbonyl] phenyl}oxalate;
bis{3,4,6-trichloro-2-[(2,2-diphenylethoxy)carbonyl] phenyl}oxalate;
bis{3,4,6-trichloro-2-[(9-fluorenylmethoxy)carbonyl] phenyl}oxalate; and
bis{3,4,6-trichloro-2-[(9-anthracenylmethoxy)carbonyl] phenyl}oxalate.

Additional examples of oxalates represented by general formula (I) are disclosed in U.S. Published Application No. 2011-0084243, the disclosure of such oxalates being incorporated herein by reference.

Examples of the at least one fluorescer useful in the systems of the present disclosure include 1-methoxy-9,10-bis(phenylethynyl)anthracene, perylene, rubrene, 16,17-didecycloxyviolanthrone, 2-ethyl-9,10-bis(phenylethynyl) anthracene; 2-chloro-9,10-bis(4-ethoxyphenyl)anthracene; 2-chloro-9,10-bis(4-methoxyphenyl)anthracene; 9,10-bis(phenylethynyl)anthracene; 1-chloro-9,10-bis(phenylethynyl)anthracene; 1,8-dichloro-9,10-bis(phenylethynyl)anthracene; 1,5-dichloro-9,10-bis(phenylethynyl)anthracene; 2,3-dichloro-9,10-bis(phenylethynyl)anthracene; 5,12-bis(phenylethynyl)tetracene; 9,10-diphenylanthracene; 1,6,7,12-tetraphenoxy-N,N'-bis(2,6-diisopropylphenyl)-3,4,9,10-perylene dicarboximide; 1,6,7,12-tetraphenoxy-N,N'-bis(2,5-di-t-butylphenyl)-3,4,9,10-perylene dicarboximide; 1,7-di-chloro-6,12-diphenoxy-N,N'-bis(2,6-diisopropylphenyl)-3,4,9,10-perylene dicarboximide; 1,6,7,12-tetra(p-bromophenoxy)-N,N'-bis(2,6-diisopropylphenyl)-3,4,9,10-perylene dicarboximide; 1,6,7,12-tetraphenoxy-N,N'-dineopentyl-3,4,9,10-perylene dicarboximide; 1,6,7,12-tetra(p-t-butylphenoxy)-N,N'-dineopentyl-3,4,9,10-perylene dicarboximide; 1,6,7,12-tetra(o-chlorophenoxy)-N,N'-bis(2,6-diisopropylphenyl)-3,4,9,10-perylene dicarboximide; 1,6,7,12-tetra(p-chlorophenoxy)-N,N'-bis(2,6-diisopropylphenyl)-3,4,9,10-perylene dicarboximide; 1,6,7,12-tetra(o-fluorophenoxy)-N,N'-bis(2,6-diisopropylphenyl)-3,4,9,10-perylene dicarboximide; 1,6,7,12-tetra(p-fluorophenoxy)-N,N'-bis(2,6-diisopropylphenyl)-3,4,9,10-perylene dicarboximide; 1,6,7,12-tetraphenoxy-N,N'-diethyl-3,4,9,10-perylene dicarboximide; 1,7-dibromo-6,12-diphenoxy-N,N'-bis(2-isopropylphenyl)-3,4,9,10-perylene dicarboximide; 16,17-dihexyloxyviolanthrone; rubrene; 1,4-dimethyl-9,10-bis(phenylethynyl)anthracene, and mixtures thereof.

The amount of the at least one oxalate and the at least one fluorescer employed is upwardly limited only by the solubility of the ester and fluorescer in the solvent chosen. However, as would be appreciated by one in the art, the efficiency of the reaction would decrease at certain high concentrations. In certain embodiments, the at least one oxalate is present in an amount ranging from 3 percent to 60 percent by weight, based on the total weight of the two-part composition. For example, the at least one oxalate can be present in an amount ranging from 3 percent to 50 percent by weight, based on the total weight of the two-part composition, such as from 3 percent to 40 percent by weight, from 3 percent to 30 percent by weight, from 5 percent to 25 percent by weight, and from 7 percent to 25 percent by weight. In certain embodiments, the at least one fluorescer is present in an amount ranging from 0.05 percent to 0.9 percent by weight based on the total weight of the two-part composition. For example, the at least one fluorescer can be present in an amount ranging from greater than 0.05 percent by weight to 0.9 percent by weight, based on the total weight of the two-part composition, such as from greater than 0.1 percent by weight, from greater than 0.2 percent by weight, from greater than 0.3 percent by weight, from greater than 0.4 percent by weight, from greater than 0.5 percent by weight, from greater than 0.6 percent by weight, from greater than 0.7 percent by weight, and from greater than 0.8 percent by weight. In addition, the at least one fluorescer can be present in an amount ranging from 0.05 percent by weight to less than 0.9 percent by weight, based on the total weight of the two-part composition, such as from less than 0.8 percent by weight, from less than 0.7 percent by weight, from less than 0.6 percent by weight, from less than 0.5 percent by weight, from less than 0.4 percent by weight, from less than 0.3 percent by weight, from less than 0.2 percent by weight, and from less than 0.1 percent by weight. It is also intended that the amount of the at least one oxalate and the at least one fluorescer can range between any of the numerical values listed above.

Examples of the at least one peroxide useful in the systems of the present disclosure include hydrogen peroxide; sodium peroxide; sodium perborate; sodium pyrophosphate peroxide; urea peroxide; histidine peroxide; t-butyl-hydroperoxide; and peroxybenzoic acid, sodium percarbonate, and mixtures thereof. In certain embodiments, the at least one peroxide is present in an amount ranging from 0.25 percent to 25 percent by weight, based on the total weight of the two-part composition. For example, the at least one peroxide can be present in an amount ranging from 0.25 percent to 20 percent by weight, based on the total weight of the two-part composition, such as from 0.5 percent to 20 percent by weight, from 0.5 percent to 15 percent by weight, from 0.5 percent to 10 percent by weight, and from 0.5 percent to 6 percent by weight. In certain embodiments, the at least one peroxide of the present disclosure can be hydrogen peroxide.

The at least one catalyst can chosen from sodium salicylate, lithium salicylate, 5-chlorolithium salicylate, triazoles (e.g., 1,2,3-triazole and 1,2,4-triazole), substituted triazoles (e.g., substituted 1,2,3-triazole and substituted 1,2,4-triazole), imidazoles, and substituted imidazoles. In certain embodiments, the at least one catalyst is present in an amount ranging from 0.0005 percent to 0.5 percent by weight, based on the total weight of the two-part composition. For example, the at least one catalyst can be present in an amount ranging from greater than 0.0005 percent by weight to 10 percent by weight, based on the total weight of the chemiluminescent marking composition, such as from 0.001 percent or greater by weight, from 0.005 percent or greater by weight, from 0.01 percent or greater by weight, from 0.05 percent or greater by weight, from 0.1 percent or greater by weight, from 0.25 percent or greater by weight, from 0.5 percent or greater by weight, from 1 percent or greater by weight, from 1.5 percent or greater by weight, from 2 percent or greater by weight, from 2.5 percent or greater by weight, from 3 percent or greater by weight, from 3.5 percent or greater by weight, from 4 percent or greater by weight, from 4.5 percent or greater by weight, from 5 percent or greater by weight, and from 7.5 percent or greater by weight. In addition, the at least one catalyst can be present in an amount ranging from 0.0005 percent by weight to less than 10 percent by weight, based on the total weight of the viscous chemiluminescent composition, such as from 7.5 percent or less by weight, from 5 percent or less by weight, from 4.5 percent or less by weight, from 4 percent or less by weight, from 3.5 percent or less by weight, from 3 percent or less by weight, from 2.5 percent or less by weight, from 2 percent or less by weight, from 1.5 percent or less by weight, from 1 percent or less by weight, from 0.5 percent or less by weight, from 0.25 percent or less by weight, from 0.1 percent or less by weight, from 0.05 percent or less by weight, from 0.01 percent or less by weight, from 0.005 percent or less by weight, and from 0.001 percent or less by weight. It is also intended that the amount of at least one catalyst can range between any of the numerical values listed above.

The systems of the present disclosure can further comprise at least one carrier. Examples of the at least one carrier for the at least first part of the systems useful in the present disclosure include dimethyl phthalate, dibutyl phthalate, dioctal phthalate, butyl benzoate, acetyl triethyl citrate, triethyl citrate, ethylene glycol dibenzoate, and propylene glycol dialkyl ether containing one to three propylene moieties and each alkyl group is independently a straight-chain or branched-chain alkyl group containing up to 8 carbon atoms. Further examples of the at least one carrier for the at least first part of the heat/light marking system include propylene glycol dialkyl ethers containing two propylene moieties such as dipropylene glycol dimethyl ether, dipropylene glycol diethyl ether and dipropylene glycol di-t-butyl ether, dibutyl phthalate, butyl benzoate, propylene glycol dibenzoate, ethylhexyl diphenyl phosphate, and mixtures thereof.

The second part of the systems of the present disclosure may optionally comprise at least one carrier. Examples of the at least one carrier for the at least one second part of the systems useful in the present disclosure include dimethyl phthalate, triethyl citrate, ethylene glycol dibenzoate, and mixtures thereof.

In certain embodiments, the at least one carrier is present in an amount ranging from 5 percent to 95 percent by weight, based on the total weight of the two-part composition. For example, the at least one carrier can be present in an amount ranging from greater than 5 percent by weight to 95 percent by weight, based on the total weight of the two-part composition, such as from greater than 10 percent by weight, from greater than 20 percent by weight, from greater than 30 percent by weight, from greater than 40 percent by weight, from greater than 50 percent by weight, from greater than 60 percent by weight, from greater than 70 percent by weight, from greater than 80 percent by weight, and from greater than 90 percent by weight. In addition, the at least one carrier can be present in an amount ranging from 5 percent by weight to less than 95 percent by weight, based on the total weight of the two-part composition, such as from less than 90 percent by weight, from less than 80 percent by weight, from less than 70 percent by weight, from less than 60 percent by weight, from less than 50 percent by weight, from less than 40 percent by weight, from less than 30 percent by weight, from less than 20 percent by weight, and from less than 10 percent by weight. It is also intended that the amount of at least one carrier can range between any of the numerical values listed above.

The systems of the present disclosure can further comprise additional components, such as thickeners to allow the marker to stick to the target better, and antifreeze agents to prevent freezing, film formers, gelling agents, polyacrylamides, and polyvinylchloride. These additional components are those well known in the art to be suitable for the above purposes.

In certain embodiments, the marking system as disclosed herein can have a self heating component.

In certain embodiments, the heat/light system of the present disclosure can be activated to generate heat and light by physically making the at least first part, comprising, e.g., at least one fluorescer, at least one oxalate ester, and at least one inorganic salt, mix and react with the at least second part, comprising, e.g., at least one peroxide and at least one catalyst. In some embodiments, a section of a module as disclosed herein contains a housing, which keeps the at least first part separate from the at least second part of the heat/light system, until such time as mixing is desired. For example, a section of a module as disclosed herein may comprise two ampoules. The first ampoule contains the at least first part comprising the at least one oxalate ester, and the second ampoule contains the at least second part comprising the at least one peroxide. For another example, the first ampoule containing the at least first part comprising the at least one oxalate ester resides within a certain section of a module, and the second ampoule comprising the at least one peroxide is separately contained within the enclosure shell of the section of the module. For yet another example, the second ampoule comprising the at least one peroxide resides within a certain section of a module, and the first ampoule containing the at least first part comprising one oxalate ester is separately contained within the enclosure shell of the section. Of course, the first and second part of the heat/light system can be separately contained in any flexible container, such as a hollow flexible tubing or a breakable vial, and upon impact or other disruptive force, the flexible container breaks and the first and second part can be in contact.

In some embodiments, the chemical light system as disclosed herein can comprise two components, e.g., an "oxalate component" comprising at least one oxalate ester, and a "peroxide component" comprising at least one peroxide, which are maintained separately until activation. In addition, an appropriate fluorescer can also be contained in one of these components. An appropriate catalyst, which can enhance intensity and lifetime control, may also be contained in one of the components. In one example, the oxalate component can provide an oxalate ester-solvent combination which permits suitable ester solubility and storage stability. In another example, the peroxide component can provide a hydrogen peroxide-solvent combination that permits suitable hydrogen peroxide solubility and storage stability.

As disclosed herein, a fluorescent system includes any system that generates a signal via, but not limited to, fluorescence. In some embodiments, a fluorescent system comprises at least one fluorescer. The at least one fluorescer may be in the form of a powder or in an appropriate solution.

In certain embodiments, the chemical light system itself may comprise a fluorescer.

As disclosed herein, a thermal-generating system can be any system that generates heat. For example, a heat signal may be generated by an exothermal chemical reaction.

Other embodiments of the disclosure will be apparent to those skilled in the art from consideration of the specification and practice of the disclosure herein. It is intended that the specification and examples be considered as exemplary only, with a true scope and spirit of the disclosure being indicated by the following claims.

What is claimed is:

1. A marking system for use with a projectile comprising at least one module, which comprises a first section, a second section, and a third section, and wherein the at least one module activates such that light or heat is generated upon an expulsion charge initiation, and wherein the marking system generates multiple signals;

the first section comprises a fluorescent system, a thermal-generating system, and a chemical light system, wherein the fluorescent system and the chemical light system generate substantially the same first color, the second section comprises a fluorescent system, a thermal-generating system, and a chemical light system, wherein the fluorescent system and the chemical light system generate substantially the same second color, and the third section comprises a fluorescent system, a thermal-generating system, and a chemical light system, wherein the fluorescent system and the chemical light system generate substantially the same third color.

2. The marking system according to claim 1, wherein at least two of the first, second, and third colors are different.

3. The marking system according to claim 2, wherein the marking system is comprised within a projectile chosen from 18 mm rocket propelled grade munitions, howitzer shells, gravity bombs, small caliber munitions used in pistols, small caliber munitions use in handguns, medium caliber munitions ranging from 20 mm to 83 mm, and larger caliber munitions ranging from 83 mm to 155 mm.

4. The marking system according to claim 2, wherein the marking system is comprised within a 40 mm projectile.

5. The marking system according to claim 2, wherein the marking system generates a signal that is visible in the daylight and a signal that is visible in darkness.

6. The marking system according to claim 1, wherein the marking system generates a signal that is visible in the daylight and a signal that is visible in darkness.

7. The marking system according to claim 1, wherein the marking system is comprised within a projectile chosen from 18 mm rocket propelled grade munitions, howitzer shells, gravity bombs, small caliber munitions used in pistols, small caliber munitions use in handguns, medium caliber munitions ranging from 20 mm to 83 mm, and larger caliber munitions ranging from 83 mm to 155 mm.

8. The marking system according to claim 1, wherein the marking system is comprised within a 40 mm projectile.

9. A marking system for use with a projectile comprising at least three modules, wherein at least one of the at least three modules activates such that light or heat is generated upon a delayed expulsion charge initiation, wherein each of the at least three modules comprises a first section, a second section, and a third section, and wherein the first section comprises a fluorescent system, a thermal-generating system, and a chemical light system, wherein the fluorescent system and the chemical light system generate substantially the same first color, the second section comprises a fluorescent system, a thermal-generating system, and a chemical light system, wherein the fluorescent system and the chemical light system generate substantially the same second color, and the third section comprises a fluorescent system, a thermal-generating system, and a chemical light system, wherein the fluorescent system and the chemical light system generate substantially the same third color.

10. The marking system according to claim 9, wherein at least two of the first, second, and third colors are different.

11. The marking system according to claim 10, wherein the marking system is included within a projectile chosen from 18 mm rocket propelled grade munitions, howitzer shells, gravity bombs, small caliber munitions used in pistols, small caliber munitions use in handguns, medium caliber munitions ranging from 20 mm to 83 mm, and larger caliber munitions ranging from 83 mm to 155 mm.

12. The marking system according to claim 10, wherein the marking system is included within 40 mm projectile.

13. The marking system according to claim 10 wherein at least two of the at least three modules activates such that light or heat is generated upon a delayed expulsion charge initiation.

14. The marking system according to claim 10, wherein at least three of the at least three modules activates such that light or heat is generated upon a delayed expulsion charge initiation.

15. The marking system according to claim 10, wherein the marking system generates a signal that is visible in the daylight and a signal that is visible in darkness.

16. The marking system according to claim 9, wherein at least two of the at least three modules activates such that light or heat is generated upon a delayed expulsion charge initiation.

17. The marking system according to claim 9, wherein at least three of the at least three modules activates such that light or heat is generated upon a delayed expulsion charge initiation.

18. The marking system according to claim 9, wherein the marking system generates a signal that is visible in the daylight and a signal that is visible in darkness.

19. The marking system according to claim 9, wherein the marking system is included within a projectile chosen from 18 mm rocket propelled grade munitions, howitzer shells, gravity bombs, small caliber munitions used in pistols, small caliber munitions use in handguns, medium caliber munitions ranging from 20 mm to 83 mm, and larger caliber munitions ranging from 83 mm to 155 mm.

20. The marking system according to claim 9, wherein the marking system is included within 40 mm projectile.

* * * * *